US006067817A

United States Patent [19]

Magnet et al.

[11] Patent Number: 6,067,817

[45] **Date of Patent: *May 30, 2000**

[54] PROCESS AND INSTALLATION FOR THE SUPPLY OF AN APPARATUS FOR SEPARATING AIR

[75] Inventors: Didier Magnet, Vincennes; Emmanuel Garnier, Paris; Bernard Saulnier, Colombes, all of France; Jean-Louis Girault, Liege, Belgium

[73] Assignee: L'Air Liquide, Societe Anonyme pour L'Etude et L'Exploitation des Procedes Georges Claude, Paris Cedex, France

[ * ] Notice: This patent is subject to a terminal disclaimer.

[21] Appl. No.: 09/000,863

[22] Filed: Dec. 30, 1997

Related U.S. Application Data

[62] Division of application No. 08/832,173, Apr. 8, 1997, Pat. No. 5,794,457.

[30] Foreign Application Priority Data

Sep. 25, 1996 [FR] France ..... 96 11681

[51] Int. Cl.[7] ..... F25J 3/04

[52] U.S. Cl. ..... 62/641; 62/908; 62/909

[58] Field of Search ..... 62/641, 643, 646, 62/653, 908, 909

[56] References Cited

U.S. PATENT DOCUMENTS

| | | |
|---|---|---|
| 5,089,034 | 2/1992 | Markovs et al. . |
| 5,388,395 | 2/1995 | Scharpf et al. . |
| 5,666,823 | 9/1997 | Smith et al. . |

FOREIGN PATENT DOCUMENTS

| | | |
|---|---|---|
| 0 069 454 | 1/1983 | European Pat. Off. . |
| 2 686 405 | 7/1993 | France . |
| 7-144114 | 6/1995 | Japan . |

*Primary Examiner*—Christopher B. Kilner
*Attorney, Agent, or Firm*—Young & Thompson

[57] ABSTRACT

Air is supplied to an air separation apparatus via a heat exchanger in which the entering air is cooled against an air gas separated in the separation apparatus. The air is first compressed in an adiabatic compressor. The air gas separated in the separation apparatus is humidified after it leaves the separation apparatus but before it reaches the heat exchanger.

9 Claims, 2 Drawing Sheets

PROCESS AND INSTALLATION FOR THE SUPPLY OF AN APPARATUS FOR SEPARATING AIR

This applicatin is a division application of U.S. application Ser. No. 08/832,173, filed Apr. 8, 1997, now U.S. Pat. No. 5,794,457, issued Aug. 18, 1998.

This application corresponds to French application 96 11681 of Sep. 25, 1996, the disclosure of which is incorporated herein by reference.

FIELD OF THE INVENTION

The present invention relates to a process and an installation for the supply of an apparatus for separating air.

BACKGROUND OF THE INVENTION

Apparatus for the separation of air gases is generally supplied with air from at least one isothermal compressor provided with interstage refrigeration, in which the air is cooled by heat exchange with the refrigeration air.

The air leaving the compressor is itself cooled in a final cooler or in an air/water tower, generally associated with a water/nitrogen tower and/or a refrigeration group. This system, generally called "precooling", permits obtaining air at a relatively low temperature (about 15° C.) before directing it toward a dryer, thereby limiting the load on this latter, the quantity of water contained in the air increasing exponentially with temperature. Such systems are described in "Current Alternatives by the Use of CFCs in Air Separation and Liquefaction Processes" by Walter F. Castle, Kryogenika 1996.

It is known to use the heat of the refrigerant of the compressor to reheat the regeneration gas, from JP 62-335691, JP 196772/94, and FR-2 686 405 and JP 7-144114.

However, the compressors used are isothermal compressors.

It is an object of the present invention to decrease the cost of an air separation unit.

SUMMARY OF THE INVENTION

To carry out the object of the invention, there is provided a supply process for an air separation apparatus in which at least one of the air compressors is an adiabatic compressor.

According to other aspects of the invention:

all the air compressed by the adiabatic compressor is sent to the air separation apparatus;

the air from the adiabatic compressor is cooled by at least one of the air gases from the air separation apparatus;

one of the air gases reheated by the compressed air in the adiabatic compressor is then sent to an air purification unit in which it serves for regeneration;

the air gas sent to regeneration is a moist gas;

the air from the adiabatic compressor is cooled by air gases from the separation apparatus in a heat exchange line before being sent to a purification unit in which it is purified of water and/or $CO_2$;

the purified air is returned to the heat exchange line;

the purification from water and purification from $CO_2$ take place at two different temperatures;

at least one portion of the air destined for the apparatus is cooled in a heat exchange line by a flow of an air gas, particularly impure nitrogen from the separation apparatus, characterized in that the flow of the air gas is humidified before reentering the heat exchange line.

According to another object of the invention, there is provided an installation for the supply of an air separation apparatus, in which at least one of the air compressors is an adiabatic compressor.

According to other aspects of the invention:

the adiabatic compressor is dedicated to the air separation apparatus;

the air separation apparatus is a cryogenic distillation apparatus;

there is a heat exchange line and means to send the air from the adiabatic compressor and at least one of the air gases from the air separation apparatus, to this heat exchange line;

there is means to humidify one of the air gases upstream of the heat exchange line.

According to another object of the invention, there is provided a process for the supply of an apparatus for the separation of air by cryogenic distillation, in which at least one portion of the air destined for the apparatus A is cooled in a heat exchange line by a flow of an air gas, particularly impure nitrogen from the separation apparatus, characterized in that the flow of the air gas is humidified before reentering the heat exchange line.

According to another object of the invention, there is provided an installation for the supply of an apparatus for the separation of air by cryogenic distillation, comprising means to send a flow of air and of an air gas to a heat exchange line, characterized in that it comprises means to humidify the air gas upstream of the heat exchange line.

As adiabatic compressors have no refrigerant, the cost of installation is reduced by omitting water refrigeration in the circuit for supplying air to the air gas separation unit, as well as the assembly of the associated cooling water circuit, including among other things, the water refrigeration towers, the water treatment, the water pumps, the distribution network, the valving, the electrical supply and associated instrumentation, and finally the system for precooling with water the air supplying the air gas separation unit.

This invention also has the advantage of decreasing the cost of operation by a substantial reduction of water consumption, by avoiding the cost of maintenance of the water system associated with avoiding possible problems of corrosion of the water circuit and periodic replacement of certain components (refrigerants, etc.) and by the avoidance of electrical consumption of the water pumps and the fans of the water refrigeration towers.

In the case of a system for the purification of air of water and $Co_2$ of the decarbonation drying type with a bed or beds of adsorbent or adsorbents or of any other system not permitting purification in the heat exchange line, the air will be withdrawn from the heat exchange line with the products leaving to be purified of water and $CO_2$ and then reintegrated into the heat exchange line. The withdrawal temperature of the air will be selected so as to optimize the load of the water and $CO_2$ purification system. On the other hand, the purification from water and $CO_2$ could be carried out at two different withdrawal temperatures, which will be selected so as to optimize the economy of the assembly of the heat exchange line and purification system.

BRIEF DESCRIPTION OF THE DRAWINGS

Two examples of the practice of the invention will now be described with respect to the accompanying drawings, in which the Figures show schematically two embodiments of an installation for the supply of an air separation apparatus according to the invention.

DETAILED DESCRIPTION OF THE INVENTION

Figure 1:
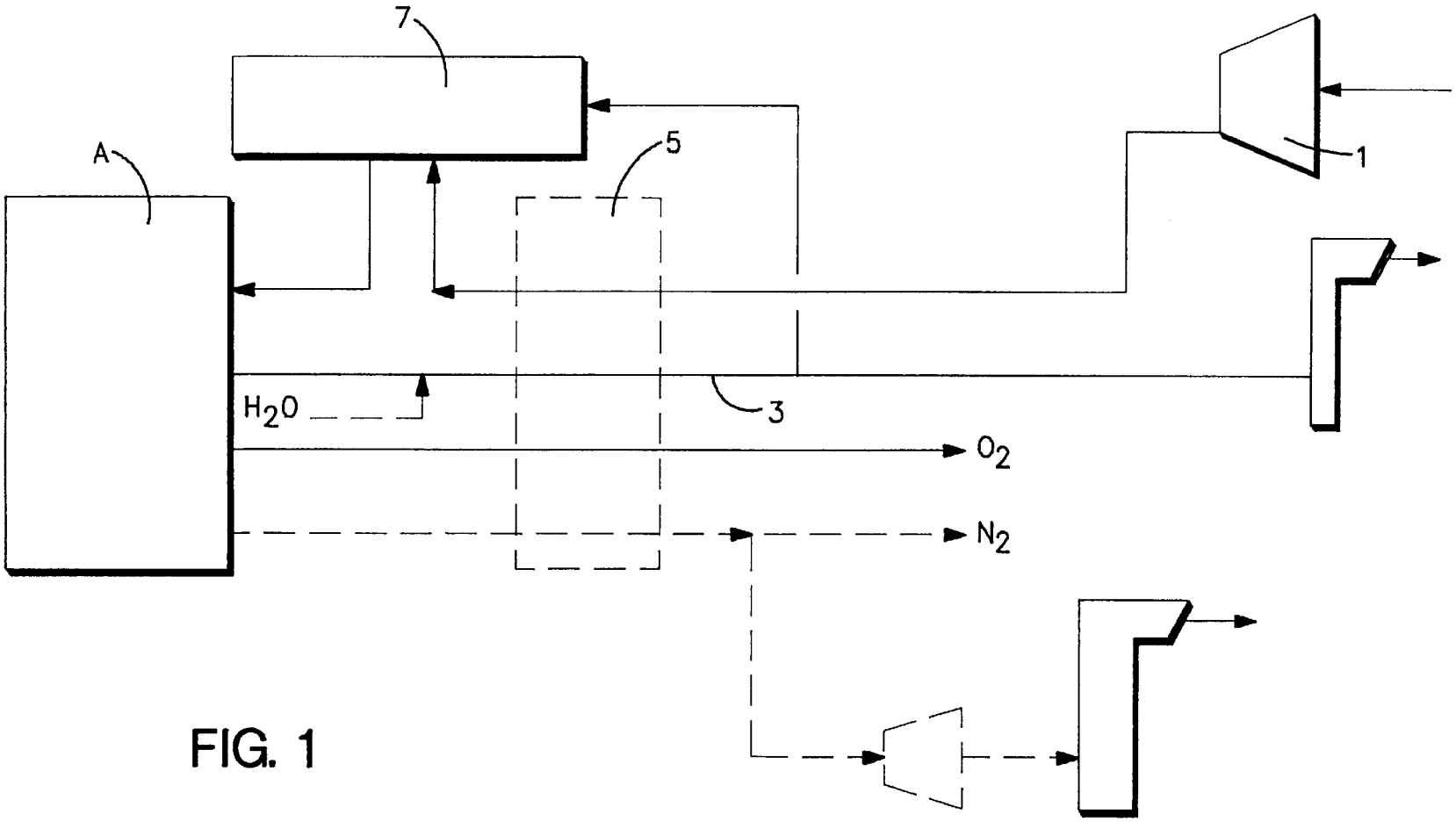
Figure 2:
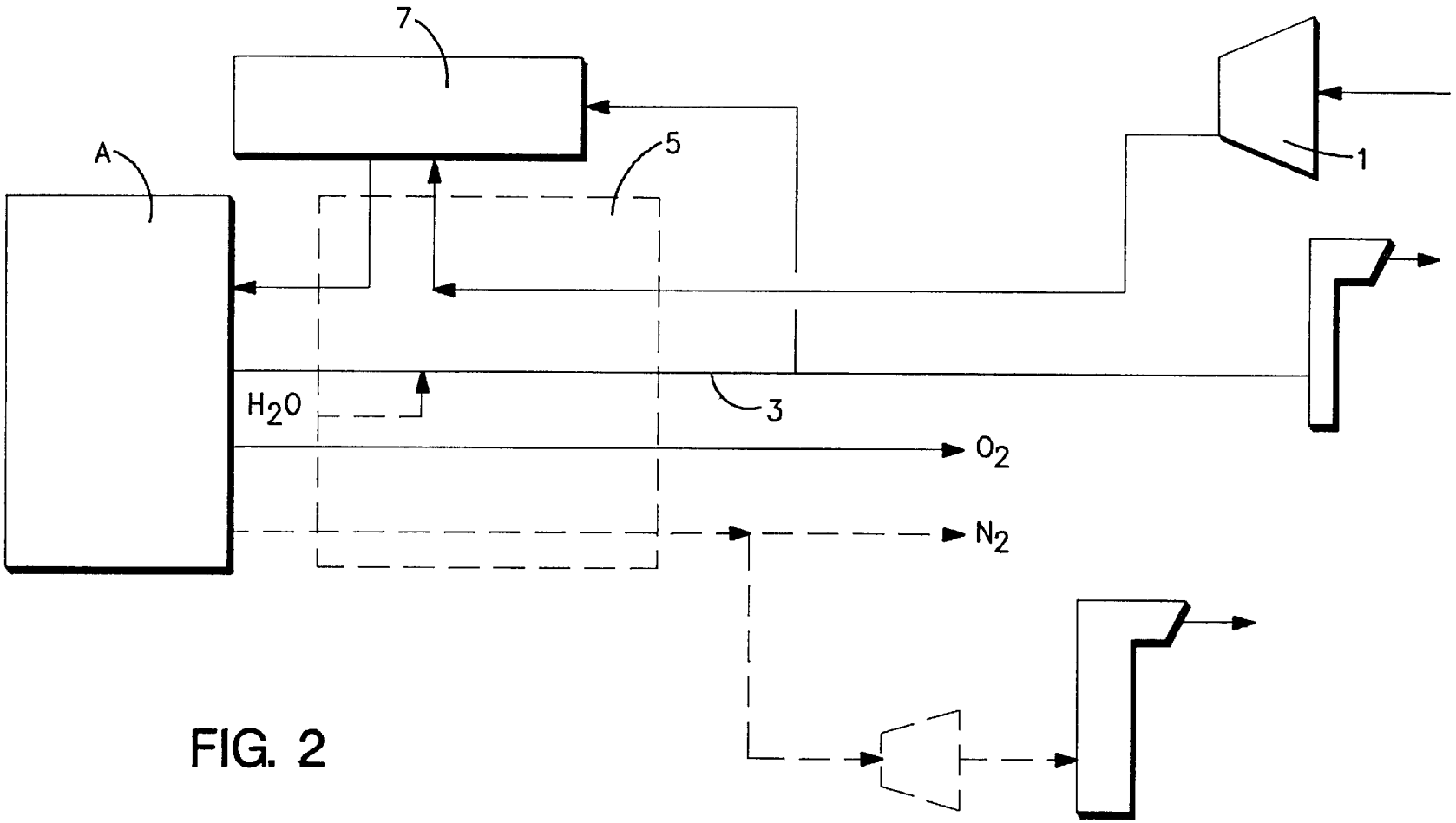

All the air destined for the air separation apparatus A is compressed by an adiabatic air compressor 1. The compressed air is at 200° C. and must be cooled either with a water refrigerant (direct or indirect contact) or by heat exchange with all the products or a portion of the products leaving the separation apparatus A, or by passage through an absorption refrigerating group, or by several of these systems. In the example, impure nitrogen 3 from apparatus A cools the air which passes through the heat exchanger 5.

The air is then purified in the purification unit 7, which is regenerated by a portion of the impure nitrogen reheated in the exchanger 5.

The impure nitrogen can be saturated with water upstream of the exchanger 5, which gives rise to a drop in temperature of this latter and thereby increases its capacity to cool the entering air (see the broken line $H_2O$ arrow).

The air from the adiabatic compressor 1 can be cooled against flows of air gas other than impure nitrogen, in the heat exchange line.

What is claimed is:

1. Process for the supply of air to an air separation apparatus comprising compressing air in an adiabatic compressor, cooling said compressed air in a heat exchanger against return streams from said air separation apparatus, thereafter purifying said cooled air to remove water and $CO_2$ and then supplying the purified air to said air separation apparatus.

2. Process according to claim 1, wherein all of the air compressed by the adiabatic compressor is sent to the air separation apparatus.

3. Process according to claim 1, in which one of the air gases reheated by the compressed air in the adiabatic compressor is then sent to an air purification unit in which it serves for regeneration.

4. Process according to claim 3, in which air gas sent to regeneration is a moist gas.

5. Process according to claim 1, in which the purified air is returned to the heat exchange line.

6. Process according to claim 1, wherein the purification from water and the purification from $CO_2$ take place at two different temperatures.

7. An installation for the separation of air comprising an air separation unit that produces cold return streams, a heat exchanger, a purification unit, an adiabatic compressor for compressing air and sending the compressed air to the heat exchanger, means for sending the compressed air from the heat exchanger to the purification unit and from the purification unit to the air separation unit, and means for sending return steams from the air separation unit to the heat exchanger to cool the heat exchanger.

8. Installation according to claim 7, in which the adiabatic compressor is dedicated to the air separation apparatus.

9. Installation according to claim 7, in which the air separation apparatus is a cryogenic distillation apparatus.

* * * * *